US011809099B2

(12) United States Patent
You et al.

(10) Patent No.: US 11,809,099 B2
(45) Date of Patent: Nov. 7, 2023

(54) CLEANING STRUCTURE FOR INTERMEDIATE TRANSFER BELT WITH STORAGE SPACE EQUIPPED WITH SHUTTER

(71) Applicant: HEWLETT-PACKARD DEVELOPMENT COMPANY, L.P., Spring, TX (US)

(72) Inventors: Hogun You, Seongnam-si (KR); Wonkook Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/915,221

(22) PCT Filed: Mar. 24, 2021

(86) PCT No.: PCT/US2021/023836
§ 371 (c)(1),
(2) Date: Sep. 28, 2022

(87) PCT Pub. No.: WO2021/206907
PCT Pub. Date: Oct. 14, 2021

(65) Prior Publication Data

US 2023/0113119 A1 Apr. 13, 2023

(30) Foreign Application Priority Data

Apr. 8, 2020 (KR) ..... 10-2020-0042682

(51) Int. Cl.
*G03G 15/00* (2006.01)
*G03G 15/16* (2006.01)
(Continued)

(52) U.S. Cl.
CPC ..... *G03G 15/161* (2013.01); *G03G 15/0136* (2013.01); *G03G 15/0886* (2013.01);
(Continued)

(58) Field of Classification Search
CPC ..... G03G 15/161; G03G 15/0136; G03G 2215/0193; G03G 2215/1661
(Continued)

(56) References Cited

U.S. PATENT DOCUMENTS 6,134,402 A * 10/2000 Nakayama ..... G03G 15/011 399/101
6,640,077 B2 * 10/2003 Suzuki ..... G03G 15/167 271/7
(Continued)

FOREIGN PATENT DOCUMENTS

JP 11-219081 A 8/1999
JP 2001-147564 A 5/2001
(Continued)

*Primary Examiner* — Robert B Beatty
(74) *Attorney, Agent, or Firm* — Foley & Lardner LLP

(57) ABSTRACT

An image forming apparatus includes a plurality of photosensitive drums, an intermediate transfer belt, a cleaning member to contact an inner surface of the intermediate transfer belt to remove impurities from the intermediate transfer belt, a storage member including a storage to accommodate the impurities removed by the cleaning member, and a shutter movable to a first location at which the storage is opened and a closing location at which the storage is closed.

14 Claims, 14 Drawing Sheets

(51) Int. Cl.
*G03G 15/01* (2006.01)
*G03G 15/08* (2006.01)

(52) U.S. Cl.
CPC . *G03G 15/1615* (2013.01); *G03G 2215/0193* (2013.01); *G03G 2215/1661* (2013.01)

(58) Field of Classification Search
USPC ..... 399/101, 302, 308
See application file for complete search history.

(56) References Cited

U.S. PATENT DOCUMENTS

| | | | | |
|---|---|---|---|---|
| 9,025,995 | B2 | 5/2015 | Yoshikawa | |
| 2008/0050158 | A1* | 2/2008 | Hatayama | G03G 21/10 399/358 |
| 2012/0020698 | A1 | 1/2012 | Fukao | |
| 2012/0199443 | A1* | 8/2012 | Kaneyama | G03G 15/161 198/496 |
| 2014/0119772 | A1* | 5/2014 | Sato | G03G 15/161 399/121 |
| 2015/0037063 | A1* | 2/2015 | Lu | G03G 15/1615 399/101 |
| 2015/0086235 | A1* | 3/2015 | Kudo | G03G 21/105 399/101 |
| 2019/0033753 | A1* | 1/2019 | Kudo | G03G 15/095 |

FOREIGN PATENT DOCUMENTS

| | | | |
|---|---|---|---|
| JP | 2001-296712 | A | 10/2001 |
| JP | 4812658 | B2 | 11/2011 |
| JP | 2012-150187 | A | 8/2012 |
| JP | 2016-197216 | A | 11/2016 |

* cited by examiner

CLEANING STRUCTURE FOR INTERMEDIATE TRANSFER BELT WITH STORAGE SPACE EQUIPPED WITH SHUTTER

BACKGROUND

An image forming apparatus using an electrophotographic method may form a visible toner image on a photoconductor by supplying a toner to an electrostatic latent image formed on the photoconductor, transfer the toner image to a printing medium, and fuse the transferred toner image on the printing medium.

In order to print a color image, toner images with different colors are formed on a plurality of photoconductors. The plurality of photoconductors may face a plurality of intermediate transfer rollers with an intermediate transfer belt therebetween. The intermediate transfer belt may circularly drive in a state in which the intermediate transfer belt is supported by a plurality of support rollers. The toner images are transferred to the printing medium from the plurality of photoconductors through the intermediate transfer belt.

Impurities, such as a toner, dust, etc., may be attached to an inner surface of the intermediate transfer belt. Impurities may be attached to surfaces of the intermediate transfer rollers and the plurality of support rollers. The intermediate transfer belt may be supported by the plurality of support rollers including a driving roller and a backup roller and may perform circular driving. A driving state of the intermediate transfer belt may affect the quality of the color image and the lifespan of the intermediate transfer belt.

BRIEF DESCRIPTION OF THE DRAWINGS

FIGS. 3 and 4 are cross-sectional views of a structure to open and close a storage space, according to an example, wherein FIG. 3 shows a state in which a shutter is located at an opening location and FIG. 4 shows a state in which the shutter is located at a closing location.

FIGS. 5 and 6 are cross-sectional views of a structure to open and close a storage space, according to an example, wherein FIG. 5 shows a state in which a shutter is located at an opening location and FIG. 6 shows a state in which the shutter is located at a closing location.

FIGS. 10 through 12 are views showing an operation of a printing mode conversion unit, wherein FIG. 10 shows a standby mode, FIG. 11 shows a black and white mode, and FIG. 12 shows a color mode.

FIGS. 13 through 15 are views showing a structure to detect a printing mode, according to an example, wherein FIG. 13 shows a standby mode, FIG. 14 shows a black and white mode, and FIG. 15 shows a color mode.

FIGS. 16 and 17 are views showing an operation of a printing mode conversion unit, wherein FIG. 16 shows a black and white mode and FIG. 17 shows a color mode.

DETAILED DESCRIPTION

Figure 1:
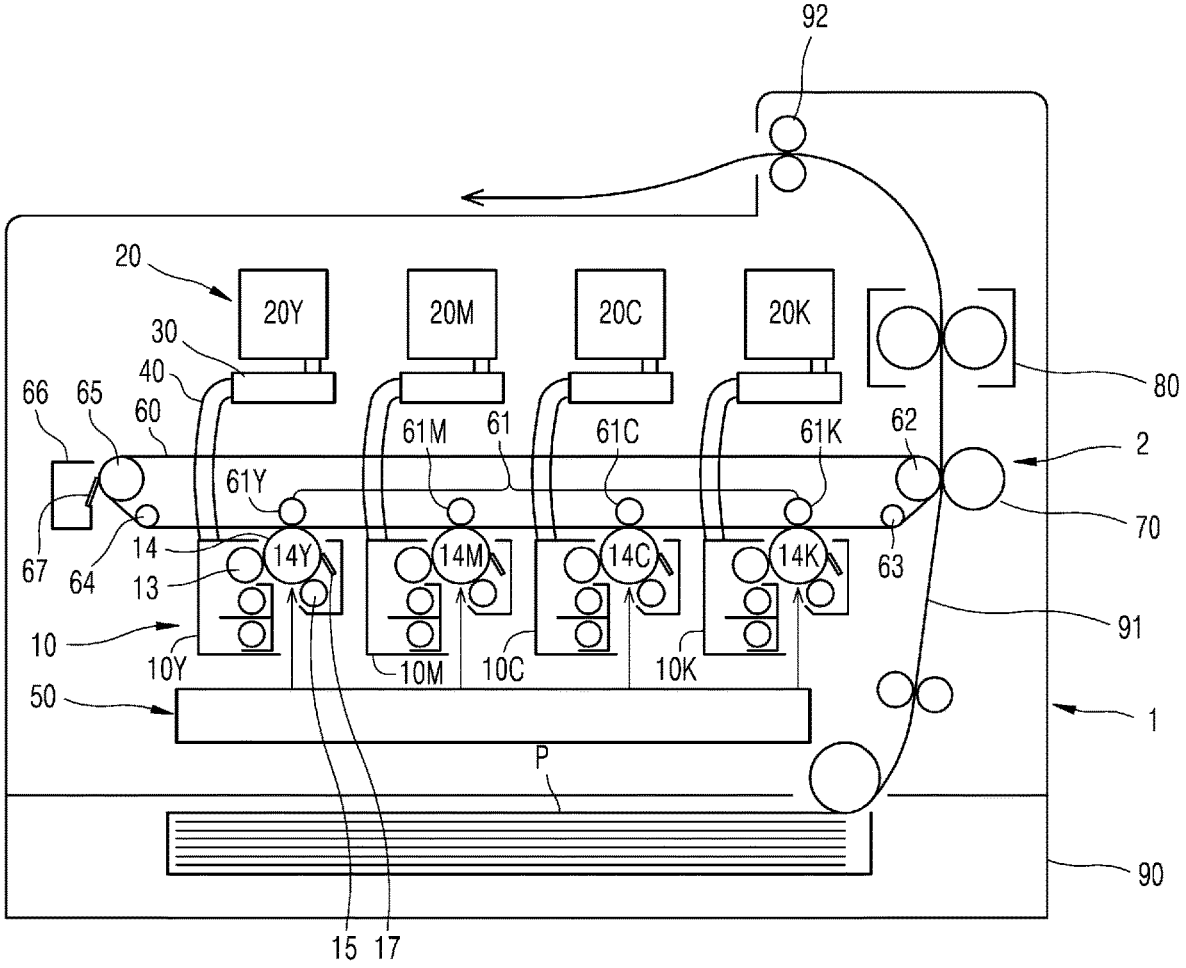
FIG. 1 is a schematic structural diagram of an image forming apparatus, according to an example.

In an image forming process using an electrophotographic method, impurities may be attached to an inner surface of an intermediate transfer belt. Impurities may be attached to outer circumferential surfaces of support rollers which drive the intermediate transfer belt, intermediate transfer rollers, and a transfer roller. The impurities may fixedly adhere to the inner surface of the intermediate transfer belt and to the outer circumferential surfaces of the support rollers, the intermediate transfer rollers, and the transfer roller. The impurities attached or fixedly adhering to the inner surface of the intermediate transfer belt, the support rollers, the intermediate transfer rollers, and the transfer roller may cause transfer defects and internal contamination of an image forming apparatus. In an image forming apparatus according to the examples disclosed herein, the impurities may be removed from the inner surface of the intermediate transfer belt and the removed impurities may be stored in a storage space. A shutter may open and close the storage space. The shutter may open the storage space to accommodate the impurities and may close the storage space so as not to discharge, to the outside, the impurities accommodated in the storage space.

Hereinafter, examples of the image forming apparatus will be described in detail with reference to the accompanying drawings. Also, the same reference numerals will be assigned to the components having substantially the same functions in this specification and the drawings, in order not to repeat the descriptions.

FIG. 1 is a schematic structural diagram of an image forming apparatus 1, according to an example. The image forming apparatus 1 according to the example may print a color image on a printing medium P by using an electrophotographic method. Referring to FIG. 1, a plurality of developing devices 10, an exposure unit 50, a transfer unit 2, and a fusing unit 80 are illustrated.

The plurality of developing devices 10 may include a plurality of developing devices 10Y, 10M, 10C, and 10K to form toner images having a yellow color Y, a magenta color M, a cyan color C, and a black color K. Developers having a yellow color Y, a magenta color M, a cyan color C, and a black color K may be accommodated in the plurality of developing devices 10Y, 10M, 10C, and 10K, respectively. The developers may be accommodated in a developer cartridge 20. For example, the developers having the yellow color Y, the magenta color M, the cyan color C, and the black color K may be accommodated in a plurality of developer cartridges 20Y, 20M, 20C, and 20K, respectively and may be supplied to the plurality of developing devices 10Y, 10M, 10C, and 10K by a developer supply unit 30. The developer supply unit 30 may be connected to the developing device 10 through a supply pipe 40. Although not shown, the developer supply unit 30 may be omitted, and the supply pipe 40 may directly connect the developer cartridge 20 and the developing device 10. The image forming apparatus 1 may further include the developer cartridge 20 and the developing device 10 to accommodate and develop developers having various colors, such as a light magenta color, a white color, etc. in addition to the colors described above.

Hereinafter, the image forming apparatus 1 including the plurality of developing devices 10Y, 10M, 10C, and 10K and the plurality of developer cartridges 20Y, 20M, 20C, and 20K will be described. Unless otherwise mentioned, reference numerals Y, M, C, and K refer to components to develop developers having a yellow color Y, a magenta color M, a cyan color C, and a black color K, respectively.

The developing device 10 may include a photosensitive drum 14, on a surface of which an electrostatic latent image is formed, and a developing roller 13 to supply the developer to the electrostatic latent image to develop the electrostatic latent image into a visible toner image. The photosensitive drum 14 may be an example of a photoconductor, on a surface of which an electrostatic latent image is formed. The photosensitive drum 14 may include a conductive metal pipe and a photosensitive layer formed at an outer circumference of the conductive metal pipe. A charging roller 15 may be an example of a charger to charge the photosensitive drum 14 to have a uniform surface electric potential. Instead of the charging roller 15, a charging brush, a corona charger, etc. may be used.

Although not shown in the drawing, the developing device 10 may further include a transfer roller cleaner to remove impurities, such as a developer, dust, etc., attached to the charging roller 15, a regulating member to regulate the amount of a developer supplied to a developing area at which the photosensitive drum 14 and the developing roller 13 face each other, etc. A cleaning member 17 may remove a developer remaining on a surface of the photosensitive drum 14 after an intermediate transfer process to be described below. The cleaning member 17 may include, for example, a cleaning blade that scrapes a developer by contacting a surface of the photosensitive drum 14. Although not shown in the drawing, the cleaning member 17 may also include a cleaning brush that contacts the surface of the photosensitive drum 14 via rotation and scrapes a developer.

A developer accommodated in the developer cartridge 20, for example, a toner, or a toner and a carrier, may be supplied to the developing device 10. The developing roller 13 may be spaced apart from the photosensitive drum 14. A distance between an outer circumferential surface of the developing roller 13 and an outer circumferential surface of the photosensitive drum 14 may be, for example, dozens to hundreds of microns. The developing roller 13 may include a magnetic roller. Also, the developing roller 13 may have the form of a magnet arranged in a developing sleeve that is rotated. The toner and the carrier may be mixed in the developing device 10, and the toner may be attached to a surface of a magnetic carrier. The magnetic carrier may be attached to a surface of the developing roller 13 and may be transported to the developing area at which the photosensitive drum 14 and the developing roller 13 face each other. A regulating member (not shown) may regulate the amount of a developer transported to the developing area. The toner may be supplied to the photosensitive drum 14 via a developing bias voltage applied between the developing roller 13 and the photosensitive drum 14, in order to develop an electrostatic latent image formed on the surface of the photosensitive drum 14 into a visible toner image.

The exposure unit 50 may form the electrostatic latent image on the photosensitive drum 14 by irradiating light modulated according to image formation onto the photosensitive drum 14. Examples of the exposure unit 50 may include a laser scanning unit (LSU) to use a laser diode as a light source, or a light-emitting diode (LED) exposure unit to use an LED as a light source, etc.

The transfer unit 2 may transfer the toner image formed on the photosensitive drum 14 to the printing medium P. According to the example, a transfer unit using an intermediate transfer method may be used. For example, the transfer unit 2 may include an intermediate transfer belt 60, intermediate transfer rollers 61, and a transfer roller 70.

The intermediate transfer belt 60 may temporarily accommodate toner images developed on the photosensitive drums 14 of the plurality of developing devices 10Y, 10M, 10C, and 10K. The intermediate transfer belt 60 may circularly drive by being supported by a plurality of support rollers 62, 63, 64, and 65. The intermediate transfer rollers 61 may be arranged at locations facing the photosensitive drums 14 of the plurality of developing devices 10Y, 10M, 10C, and 10K with the intermediate transfer belt 60 between the intermediate transfer rollers 61 and the photosensitive drums 14 of the plurality of developing devices 10Y, 10M, 10C, and 10K. The intermediate transfer roller 61 may form an intermediate transfer nip by applying pressure to the intermediate transfer belt 60 on the photosensitive drum 14. An intermediate transfer bias voltage for intermediate transferring the toner image developed on the photosensitive drum 14 to the intermediate transfer belt 60 may be applied to the intermediate transfer rollers 61.

The transfer roller 70 may be located to face the intermediate transfer belt 60. The transfer roller 70 may be located, for example, to face the support roller 62 and may be given pressure toward the intermediate transfer belt 60 to form a transfer nip. A transfer bias voltage for transferring the toner image transferred to the intermediate transfer belt 60 to the printing medium P may be applied to the transfer roller 70.

The fusing unit 80 may fuse the toner image transferred to the printing medium P to the printing medium P by applying heat and/or pressure. The shape of the fusing unit 80 is not limited to the example illustrated in FIG. 1.

Based on the structure described above, the exposure unit 50 may form electrostatic latent images on the photosensitive drums 14 by injecting a plurality of pieces of light modulated according to image information of each color to the photosensitive drums 14 of the plurality of developing devices 10Y, 10M, 10C, and 10K. The electrostatic latent images of the photosensitive drums 14 of the plurality of developing devices 10Y, 10M, 10C, and 10K may be developed into visible toner images via developers having a yellow color Y, a magenta color M, a cyan color C, and a black color K supplied from the plurality of developer cartridges 20Y, 20M, 20C, and 20K to the plurality of developing devices 10Y, 10M, 10C, and 10K. The developed toner images may be sequentially intermediate transferred to the intermediate transfer belt 60. The printing medium P stacked in a source paper unit 90 may be transported along a paper path 91 and may be transported between the transfer roller 70 and the intermediate transfer belt 60. The toner images intermediate transferred to the intermediate transfer belt 60 may be transferred to the printing medium P by a transfer bias voltage applied to the transfer roller 70. When the printing medium P passes through the fusing unit 80, the toner images may be fused to the printing medium P via heat and pressure. The printing medium P, for which fusing is completed, may be discharged by a discharge roller 92.

As described above, the intermediate transfer belt 60 may be supported by the support rollers 62, 63, 64, and 65 and may circularly drive. The support rollers 62 and 65 may be a driving roller and a backup roller which support and drive the intermediate transfer belt 60 by being apart from each other in a driving direction D of the intermediate transfer belt 60. The backup roller 65 may be a tension roller that is located in the intermediate transfer belt 60 and applies tension to the intermediate transfer belt 60.

A belt cleaner 67 may remove impurities on an outer surface of the intermediate transfer belt 60. The impurities may include, for example, a toner remaining on the outer surface of the intermediate transfer belt 60 after a toner image is transferred to the printing medium P, and dust, etc. attached to the outer surface of the intermediate transfer belt 60. The impurities removed from the outer surface of the intermediate transfer belt 60 may be stored in an impurity storage unit 66 and may be transported to and stored in an impurity accommodation member (not shown) that is replaceable, via a transportation device that is not illustrated.

Impurities may be attached to an inner surface of the intermediate transfer belt 60 in an image forming process. The impurities may include a toner scattered during the image forming process, dust introduced into the image forming apparatus 1, etc. When the impurities are continually attached to the inner surface of the intermediate transfer belt 60, the impurities may be solidly fixed thereto. Also, the impurities may be moved from the inner surface of the intermediate transfer belt 60 to surfaces of the intermediate transfer rollers 61 and the support rollers 62, 63, 64, and 65 and may be fixed thereto. Impurities may operate as electric resistors in a transfer process. When impurity layers attached to the inner surface of the intermediate transfer belt 60 and the surfaces of the intermediate transfer rollers 61 and the support rollers 62, 63, 64, and 65 become thick, the impurity layers may operate as electric resistors, and thus, the performance of a transfer process from the photosensitive drum 14 to the intermediate transfer belt 60 and the performance of a transfer process from the intermediate transfer belt 60 to the printing medium P may be deteriorated. For example, at a location of the inner surface of the intermediate transfer belt 60, at which the thick impurity layers are formed, the transfer process of the toner image may not be sufficiently performed, and thus, transfer defects, such as partial missing in an image or a partial decrease in an image concentration, may occur. Also, the thick impurity layers may damage the inner surface of the intermediate transfer belt 60 and accordingly, the intermediate transfer belt 60 may be deformed. The deformation of the intermediate transfer belt 60 may cause an image concentration defect, such as a streak shape, in the driving direction D of the intermediate transfer belt 60.

A method of reducing the deformation of the intermediate transfer belt 60 due to the impurities by increasing an elastic coefficient of the intermediate transfer belt 60 may be considered. However, the intermediate transfer belt 60 having a high elastic coefficient may have a brittle tendency, and thus, the intermediate transfer belt 60 may easily crack and the lifespan of the intermediate transfer belt 60 may be reduced. A method of implementing an elastic rubber roller as the support rollers 62, 63, 64, and 65 may be considered. However, the elastic rubber roller costs more than a metal roller and may be disadvantageous in terms of the driving safety of the intermediate transfer belt 60.

In the image forming apparatus 1 according to the example, impurities may be removed from the inner surface of the intermediate transfer belt 60. The removed impurities may be stored in the storage space. The storage space may be opened and closed. The storage space may be opened to accommodate the impurities removed from the inner surface of the intermediate transfer belt 60 and may be closed so that the impurities stored in the storage space are not scattered into the image forming apparatus 1. Based on this structure, because the storage space is closed after the removed impurities are accommodated in the storage space, the intermediate transfer belt 60 and the image forming apparatus 1 may be prevented from being contaminated due to the impurities in a process of replacing or repairing the intermediate transfer belt 60.

Figure 2:
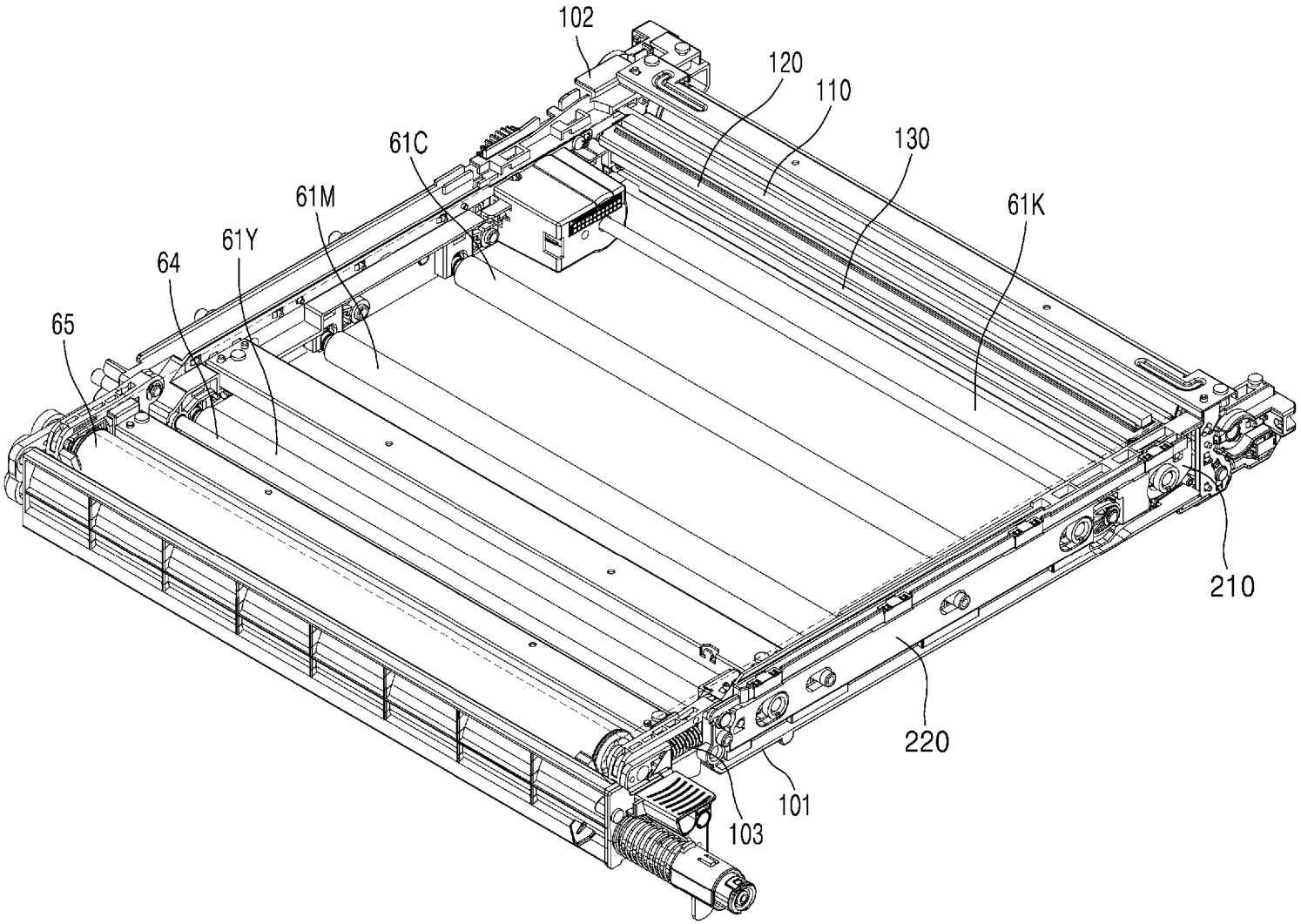
FIG. 2 is a perspective view of an intermediate transfer belt assembly, according to an example.
Figure 3:
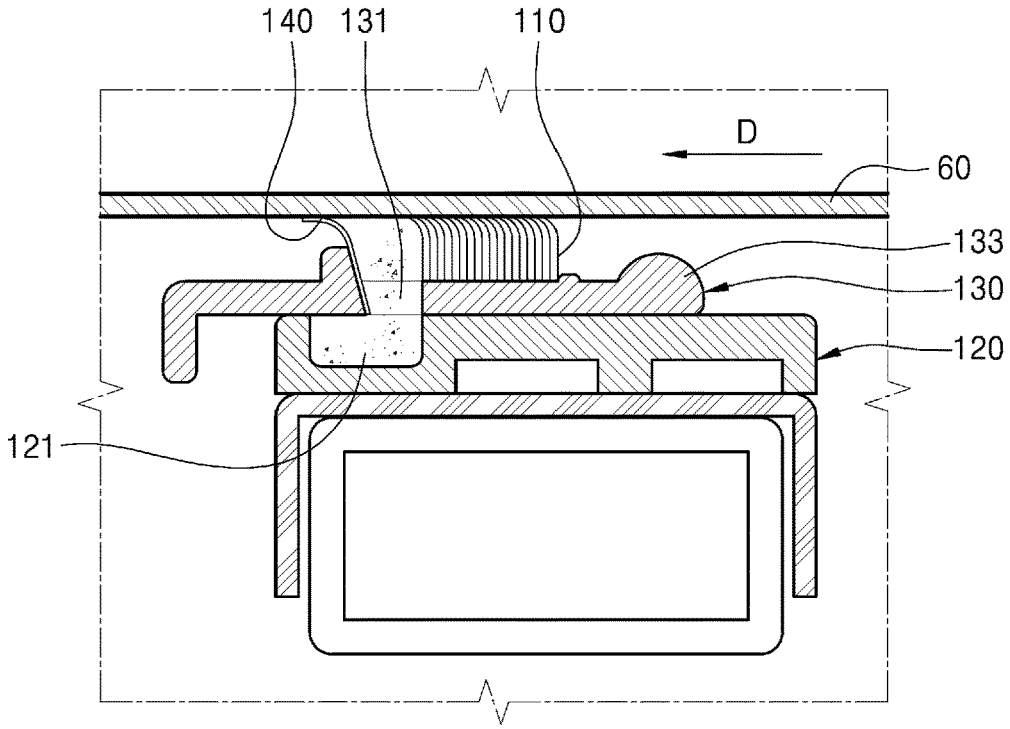
Figure 4:
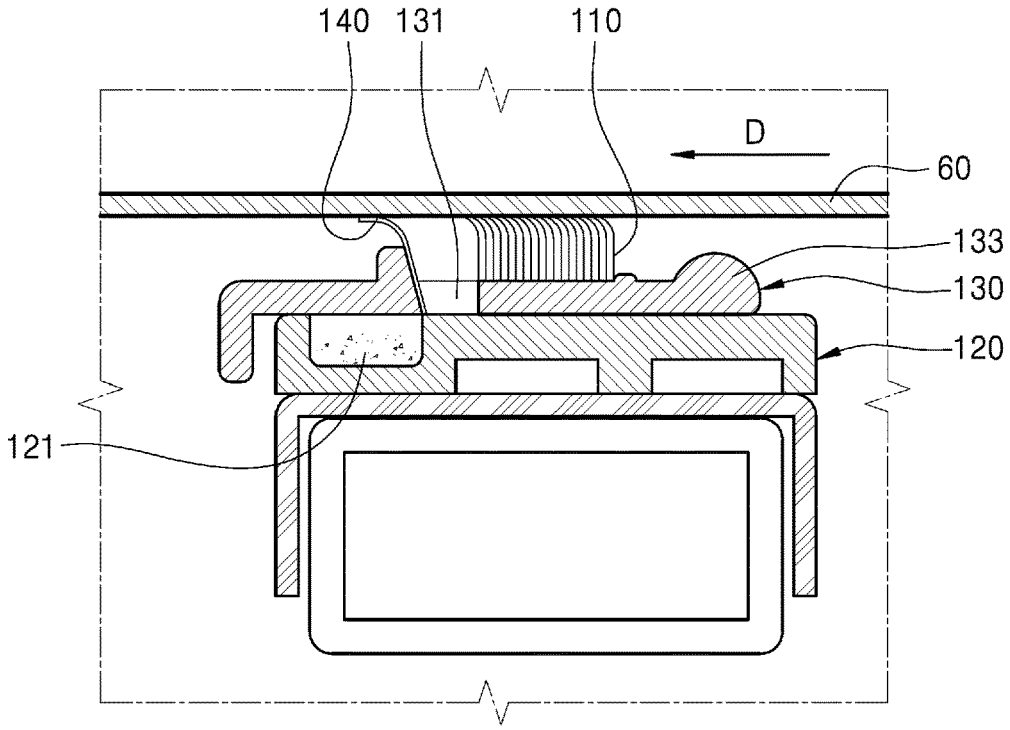

Hereinafter, examples of a structure to open and close the storage space will be described. FIG. 2 is a perspective view of an intermediate transfer belt assembly, according to an example. FIGS. 3 and 4 are cross-sectional views of a structure to open and close a storage space, according to an example, wherein FIG. 3 shows a state in which a shutter 130 is located at an opening location and FIG. 4 shows a state in which the shutter 130 is located at a closing location.

Referring to FIGS. 1 through 4, the image forming apparatus 1 according to an example may include the plurality of photosensitive drums 14, on which a toner image is formed, the intermediate transfer belt 60, to which the toner image is transferred, a cleaning member 110 to contact an inner surface of the intermediate transfer belt 60 to remove impurities, a storage member 120 having a storage 121 to accommodate the impurities, and the shutter 130, which is movable to an opening location to open the storage 121 and a closing location to close the storage 121.

Referring to FIGS. 1 and 2, the plurality of intermediate transfer rollers 61 and the support rollers 62, 63, 64, and 65 may be rotatably supported by a first frame 101 and a second frame 102 located to be apart from each other in an axial direction. As described above, the support roller 65 may be a tension roller that applies tension to the intermediate transfer belt 60. According to an example, the support roller 65 may be supported by the first and second frames 101 and 102 to be movable in the driving direction D of the intermediate transfer belt 60. A spring 103 may apply an elastic force to the support roller 65 in a direction away from the support roller 62. Tension may be applied to the intermediate transfer belt 60 due to the elastic force of the spring 103. The intermediate transfer belt 60 may have a transfer area contacting the intermediate transfer rollers 61 and a non-transfer area that is the opposite to the transfer area.

The cleaning member 110 may be located in the intermediate transfer belt 60 and may contact the inner surface of the intermediate transfer belt 60. The cleaning member 110 may contact the intermediate transfer belt 60 in the non-transfer area. The cleaning member 110 may include, for example, a brush extending in an axial direction, that is, a width direction of the intermediate transfer belt 60. As the intermediate transfer belt 60 is driven, impurities attached to the inner surface of the intermediate transfer belt 60 may be scraped by the cleaning member 110 so as to be removed from the inner surface of the intermediate transfer belt 60. Compared with a brush roller that is rotated, the cleaning member 110, which is a brush that contacts the inner surface of the intermediate transfer belt 60 at a fixed location, may not be rotated, and thus, the cleaning member 110 may not need a driving structure, may not cause vibration of the intermediate transfer belt 60, and may easily accommodate removed impurities to decrease the possibility of re-contamination of the intermediate transfer belt 60 due to the removed impurities.

The storage member 120 may be located in the intermediate transfer belt 60 below the cleaning member 110. The storage member 120 may extend in the width direction of the intermediate transfer belt 60 and may be supported by the first and second frames 101 and 102. The storage member 120 may include the storage (a first storage) 121 to accommodate the impurities. According to the example, the storage 121 may be located at a downstream of the cleaning member 110 based on the driving direction D of the intermediate transfer belt 60. Here, the driving direction D may be a driving direction of the non-transfer area of the intermediate transfer belt 60. Based on this structure, the impurities attached to the inner surface of the intermediate transfer belt 60 may have reduced adhesion to the intermediate transfer belt 60 via the cleaning member 110 and may be removed from the inner surface of the intermediate transfer belt 60. The removed impurities may be decanted into the storage 121.

The shutter 130 may open and close the storage 121. According to an example, the shutter 130 may be located in the intermediate transfer belt 60 between the non-transfer area of the intermediate transfer belt 60 and the storage member 120. The shutter 130 may be moved to the opening location (first location or open position) to open an opening of the storage 121 and the closing location (second location or closed position) to close the opening of the storage 121. The shutter 130 may be supported by the first and second frames 101 and 102 to be movable to the opening location and the closing location. The shutter 130 may be supported by the storage member 120 to be movable to the opening location and the closing location. For example, an opening (a first opening) 131 may be formed in the shutter 130. As illustrated in FIG. 3, when the shutter 130 is located at the opening location, the opening 131 may be aligned with the storage 121 to open the storage 121, and the impurities removed from the inner surface of the intermediate transfer belt 60 may be accommodated in the storage 121. As illustrated in FIG. 4, when the shutter 130 is located at the closing location, the opening unit 131 and the storage 121 may deviate from each other to close the storage 121 and the leakage of the impurities accommodated in the storage 121 may be prevented.

The image forming apparatus 1 may further include a sealing member 140, which is flexible. The sealing member 140 may contact the inner surface of the intermediate transfer belt 60 at a downstream of the storage 121 based on the driving direction D of the intermediate transfer belt 60. The sealing member 140 may be realized by using, for example, a flexible polymer film having elasticity, sponge, felt, etc. The sealing member 140 may elastically contact the inner surface of the intermediate transfer belt 60. Based on this structure, the cleaning member 110 may be located at an upstream of the storage 121 and the sealing member 140 may be located at a downstream of the storage 121, based on the driving direction D, and thus, the impurities removed from the inner surface of the intermediate transfer belt 60 may not be scattered into the image forming apparatus 1 and may be accommodated in the storage 121.

The cleaning member 110 and the sealing member 140 may be mounted at the shutter 130. For example, the cleaning member 110 and the sealing member 140 may be mounted to be adjacent to an upstream edge and a downstream edge of the opening 131, respectively. Based on this structure, scattering of the impurities removed from the inner surface of the intermediate transfer belt 60 into the image forming apparatus 1 may be effectively prevented.

Figure 5:
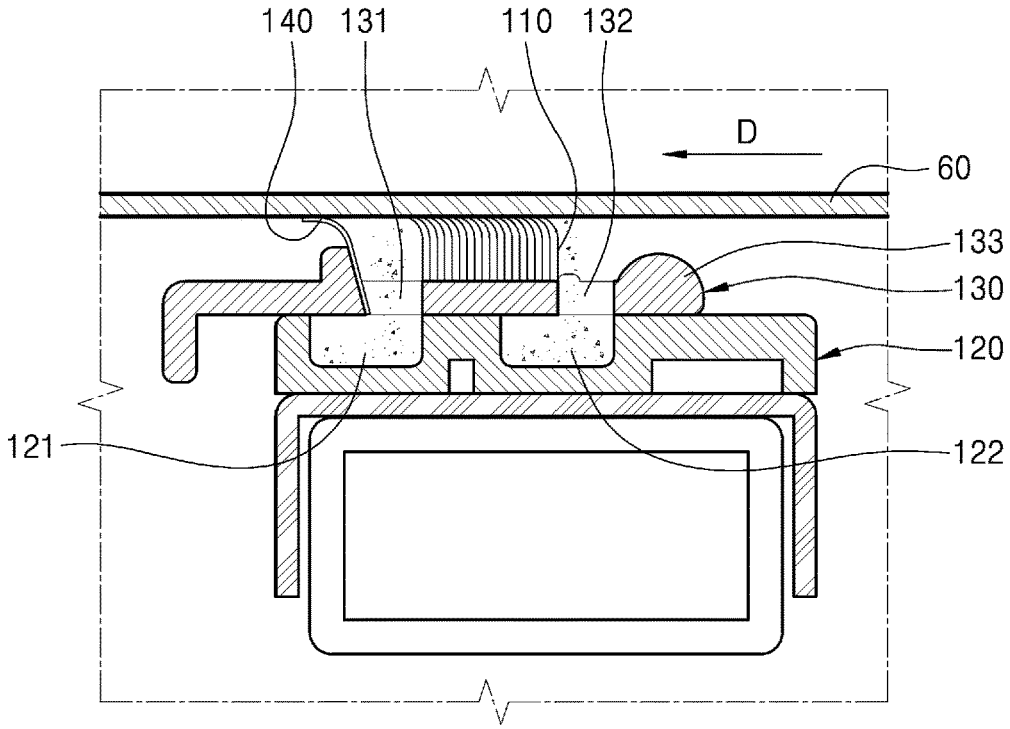
Figure 6:
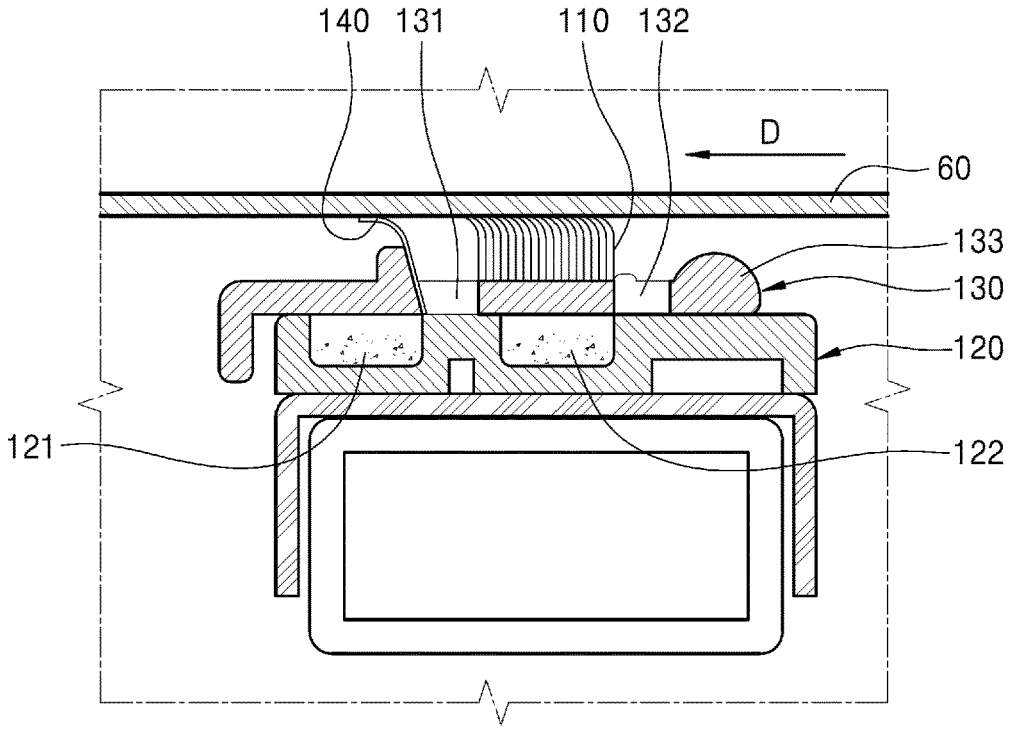

FIGS. 5 and 6 are cross-sectional views of a structure to open and close a storage space, according to an example, wherein FIG. 5 shows a state in which the shutter 130 is located at an opening location (first location or open position) and FIG. 6 shows a state in which the shutter 130 is located at a closing location (second location or closed position). Referring to FIGS. 5 and 6, the storage member 120 may include the first storage 121 located at a downstream of the cleaning member 110 and a second storage 122 located at an upstream of the cleaning member 110, based on the driving direction D of the intermediate transfer belt 60. Based on this structure, of impurities that are removed from the inner surface of the intermediate transfer belt 60 by the cleaning member 110, impurities that are pushed toward the upstream of the cleaning member 110 may be accommodated in the second storage 122, and impurities transported toward the downstream of the cleaning member 110 may be accommodated in the first storage 121.

The shutter 130 may open and close the first and second storages 121 and 122. According to an example, the first opening 131 and a second opening 132 may be formed in the shutter 130. The first opening 131 and the second opening 132 may be located at the downstream and the upstream of the cleaning member 110, respectively. As illustrated in FIG. 5, in a case where the shutter 130 is located at the opening location, the first and second openings 131 and 132 may be aligned with the first storage 121 and the second storage 122, respectively, to open the first and second storages 121 and 122, respectively, and the impurities removed from the inner surface of the intermediate transfer belt 60 may be accommodated in the first and second storages 121 and 122. As illustrated in FIG. 6, in a case where the shutter 130 is located at the closing location, the first and second openings 131 and 132 may deviate from the first and second storages 121 and 122, respectively, to close the first and second storages 121 and 122, respectively, and the impurities accommodated in the first and second storages 121 and 122 may not be leaked.

The sealing member 140 may elastically contact the inner surface of the intermediate transfer belt 60 at a downstream of the first storage 121 based on the driving direction D of the intermediate transfer belt 60. For example, the sealing member 140 may be mounted to be adjacent to a downstream edge of the first opening 131.

The shutter 130 may be selectively moved to the opening location and the closing location according to a printing mode. For example, the printing mode may include a standby mode, in which printing is not performed, a color mode, in which color printing is performed, and a black and white mode, in which black and white printing is performed.

The shutter 130 may be moved to the opening location and the closing location by an actuator not shown, for example, a motor, a solenoid, etc. According to an example, the actuator may locate the shutter 130 at the opening location in the color mode and the black and white mode so that the impurities removed from the inner surface of the intermediate transfer belt 60 may be accommodated in the first storage 121 or the first and second storages 121 and 122. Also, the actuator may locate shutter 130 at the closing location in the standby mode so that the impurities accommodated in the first storage 121 or the first and second storages 121 and 122 may not be scattered. According to an example, the actuator may locate the shutter 130 at the opening location in the color mode and may locate the shutter 130 at the closing location in the black and white mode and the standby mode.

The plurality of intermediate transfer rollers 61 may include a first intermediate transfer roller 61K for black and white printing and a plurality of second intermediate transfer rollers 61Y, 61M, and 61C for color printing. The first intermediate transfer roller 61K may face a photosensitive drum 14K. The plurality of second intermediate transfer rollers 61Y, 61M, and 61C may face photosensitive drums 14Y, 14M, and 14C, respectively. The plurality of intermediate transfer rollers 61 may be located at an intermediate transfer location to form an intermediate transfer nip by allowing the intermediate transfer belt 60 to contact the plurality of photosensitive drums 14 corresponding thereto by applying pressure to the intermediate transfer belt 60. In order to prevent deformation of the plurality of intermediate transfer rollers 61, damage to surfaces of the plurality of photosensitive drums 14 and a surface of the intermediate transfer belt 60 due to friction, and damage to photosensitive layers of the plurality of photosensitive drums 14 due to a static electricity, the intermediate transfer belt 60 may be spaced apart from at least one of the plurality of photosensitive drums 14 according to a printing mode.

To this end, at least one of the plurality of intermediate transfer rollers 61 may be moved to a releasing location to release the intermediate transfer nip according to a printing mode. For example, all of the plurality of intermediate transfer rollers 61 may be located at the intermediate transfer location in the color mode. The first intermediate transfer roller 61K may be located at the intermediate transfer location and the plurality of intermediate transfer rollers 61Y, 61M, and 61C may be located at the releasing location (e.g., at a position spaced apart from the intermediate transfer belt 60 such that pressure is not applied to the intermediate transfer belt 60), in the black and white mode. Based on this structure, the intermediate transfer belt 60 may be spaced apart from the photosensitive drums 14Y, 14M, and 14C, which are not used for printing. Thus, the possibility of damage to the intermediate transfer belt 60 and the photosensitive drums 14Y, 14M, and 14C may be reduced, and the possibility of deformation of the second intermediate transfer rollers 61Y, 61M, and 61C may be reduced. In the standby mode, all of the plurality of intermediate transfer rollers 61 may be located at the releasing location. Based on this structure, the risk of damage to the intermediate transfer belt 60 and the plurality of photosensitive drums 14 and the possibility of deformation of the plurality of intermediate transfer rollers 61 may be reduced.

The shutter 130 may be linked with the movement of at least one of the plurality of intermediate transfer rollers 61. According to an example, the plurality of intermediate transfer rollers 61 may be located to face the plurality of photosensitive drums 14, with the intermediate transfer belt 60 between the plurality of intermediate transfer rollers 61 and the plurality of photosensitive drums 14. The plurality of intermediate transfer rollers 61 may be located at the intermediate transfer location to form the intermediate transfer nip by applying pressure to the intermediate transfer belt 60 to allow the intermediate transfer belt 60 to contact the plurality of photosensitive drums 14 corresponding thereto. At least one of the plurality of intermediate transfer rollers 61 may be moved to the releasing location to release the intermediate transfer nip. The shutter 130 may be moved to the opening location and the closing location in synchronization with the movement of one of the plurality of intermediate transfer rollers 61 between the intermediate transfer location and the releasing location. According to an example, the image forming apparatus 1 may include a printing mode conversion unit to convert, according to a printing mode, at least one of the plurality of intermediate transfer rollers 61 between the intermediate transfer location to form the intermediate transfer nip by applying pressure to the intermediate transfer belt 60 so that the intermediate transfer belt 60 contacts the photosensitive drum 14 corresponding thereto, and the releasing location to release the intermediate transfer nip. The shutter 130 may be moved to the opening location and the closing location via the printing mode conversion unit.

Hereinafter, examples of a structure to move the shutter 130 between the opening location and the closing location will be described.

Figure 7:
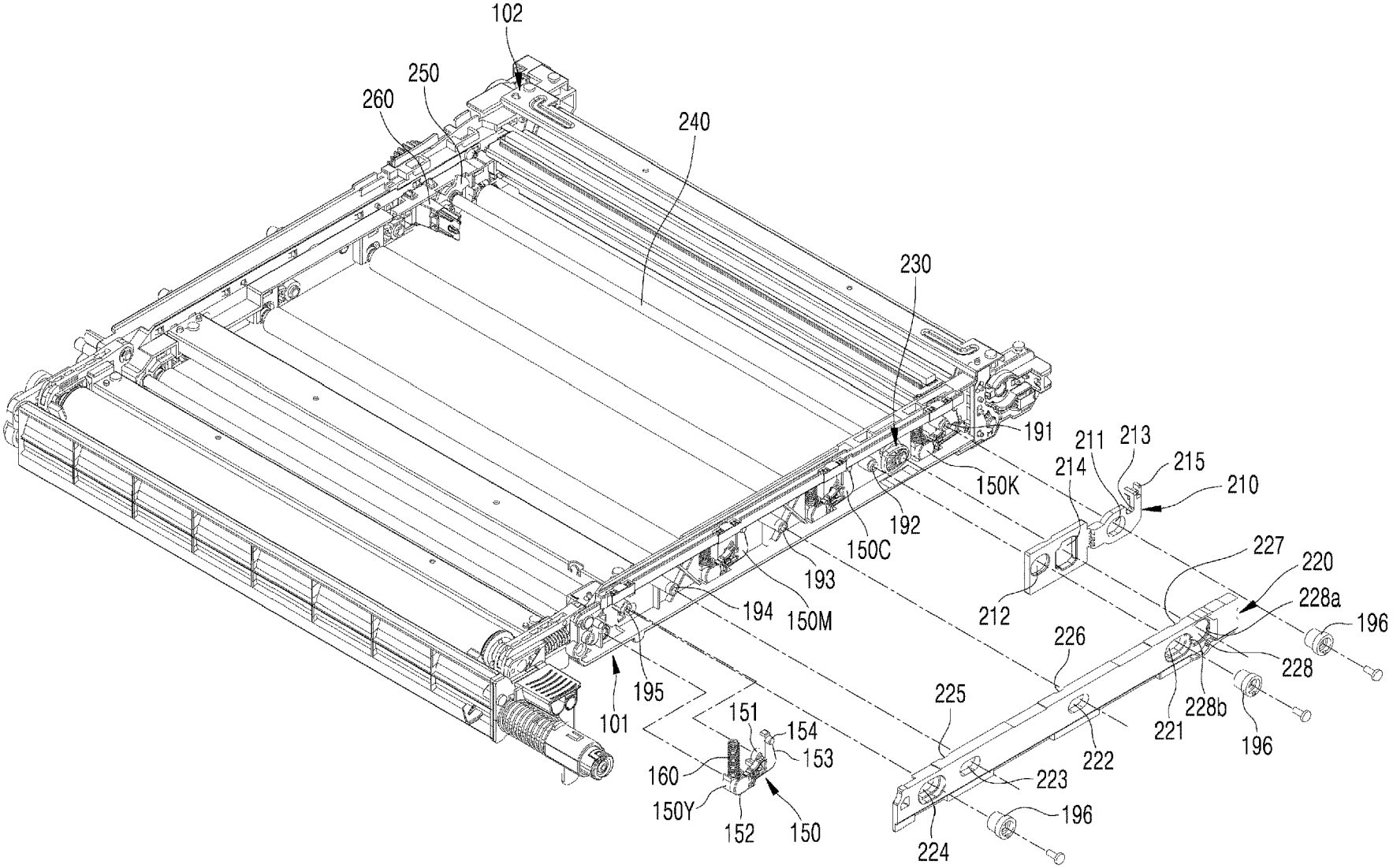
FIG. 7 is a partial exploded perspective view of an intermediate transfer belt assembly, according to an example.
Figure 8:
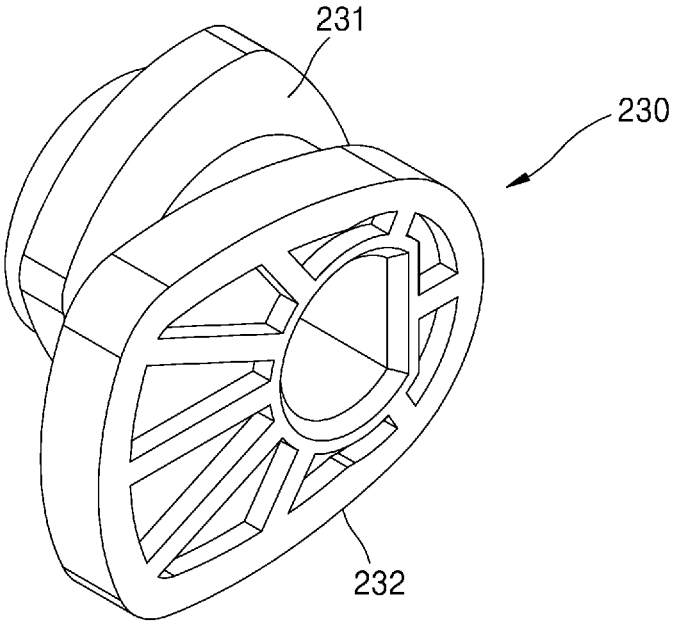
FIG. 8 is a perspective view of a cam member, according to an example.
Figure 9:
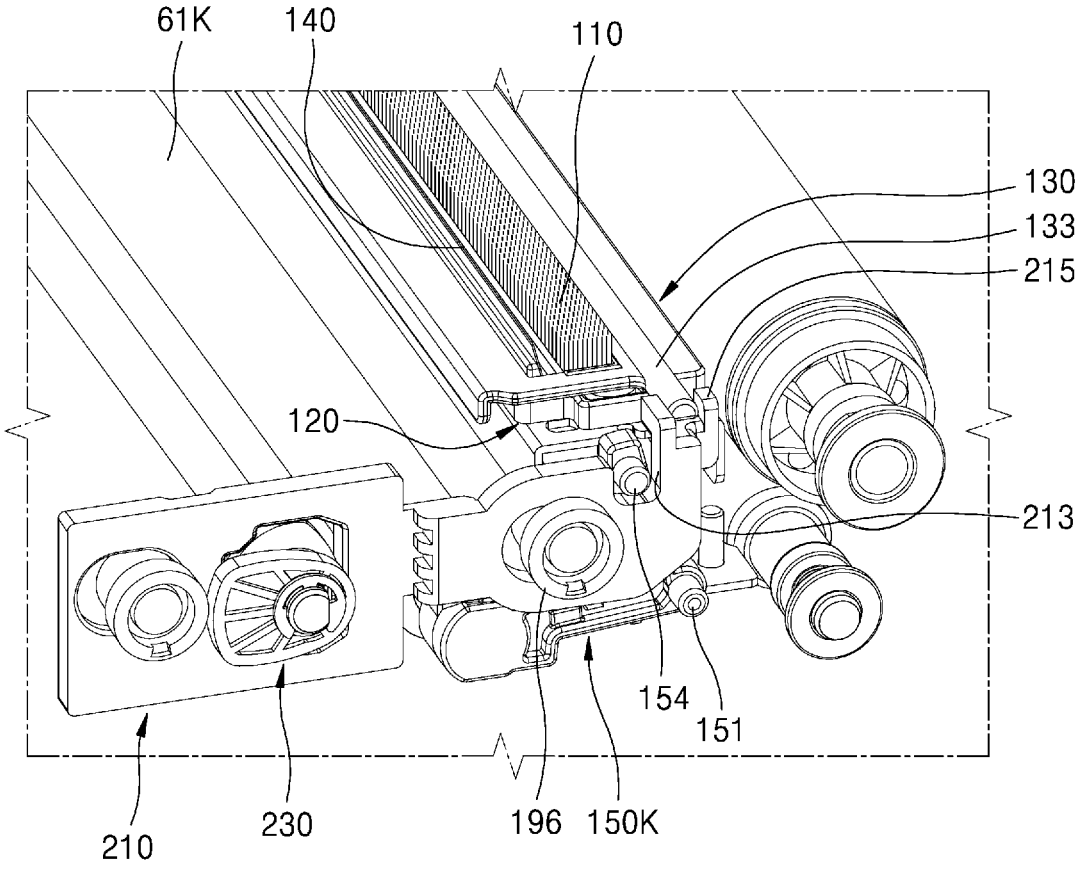
FIG. 9 is a perspective view of a connection structure of a shutter and a first movement member, according to an example.
Figure 10:
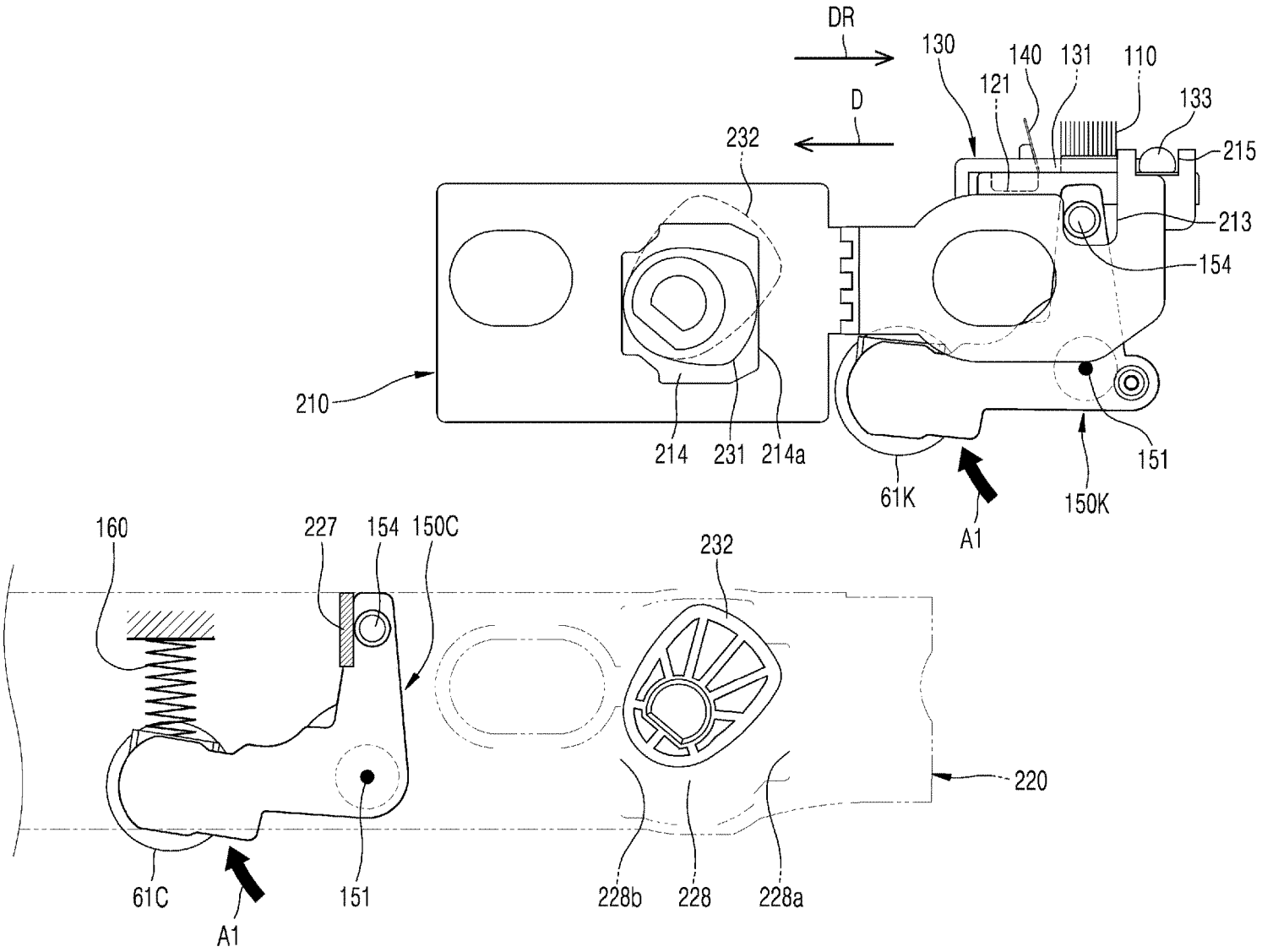
Figure 11:
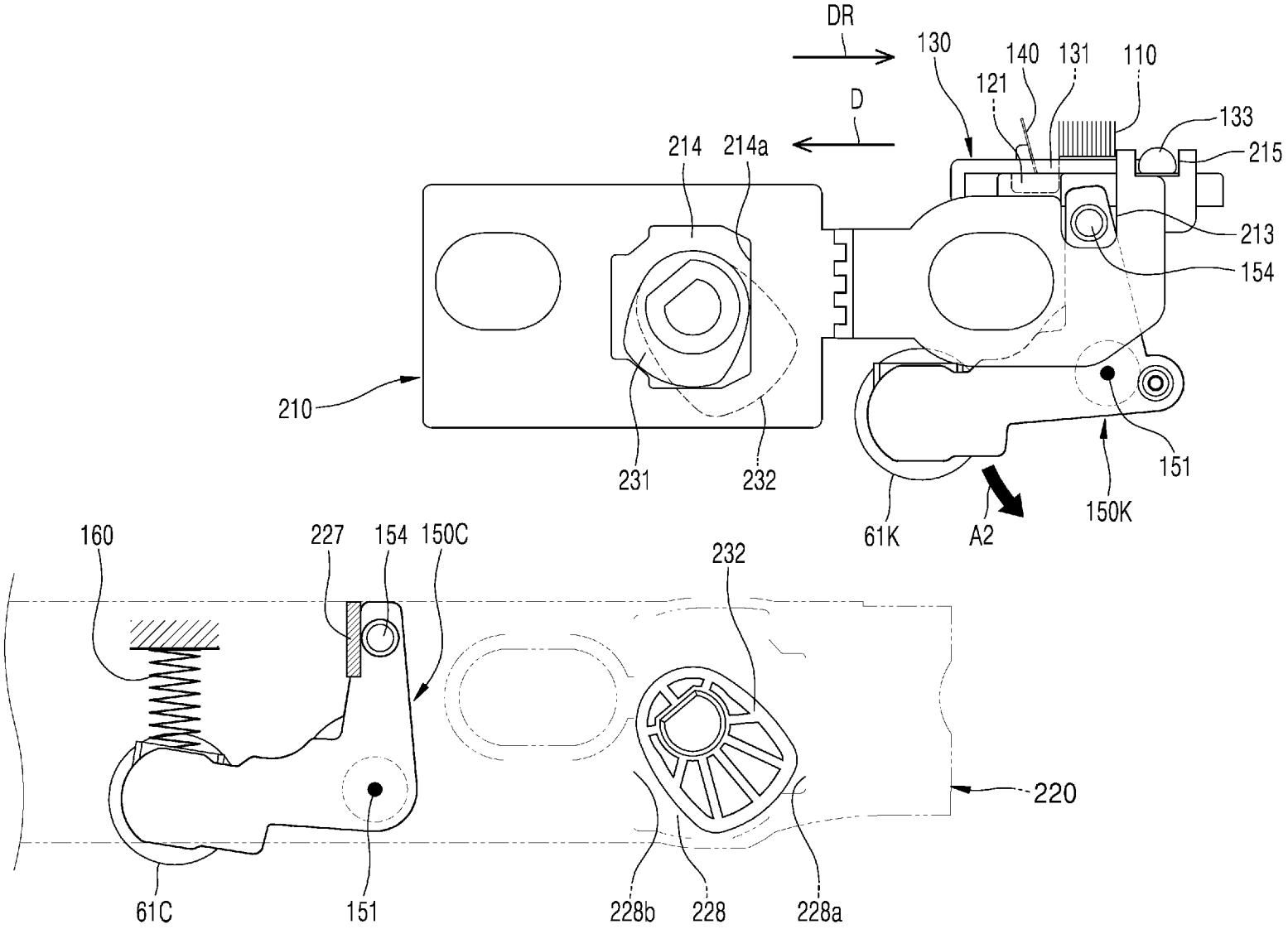
Figure 12:
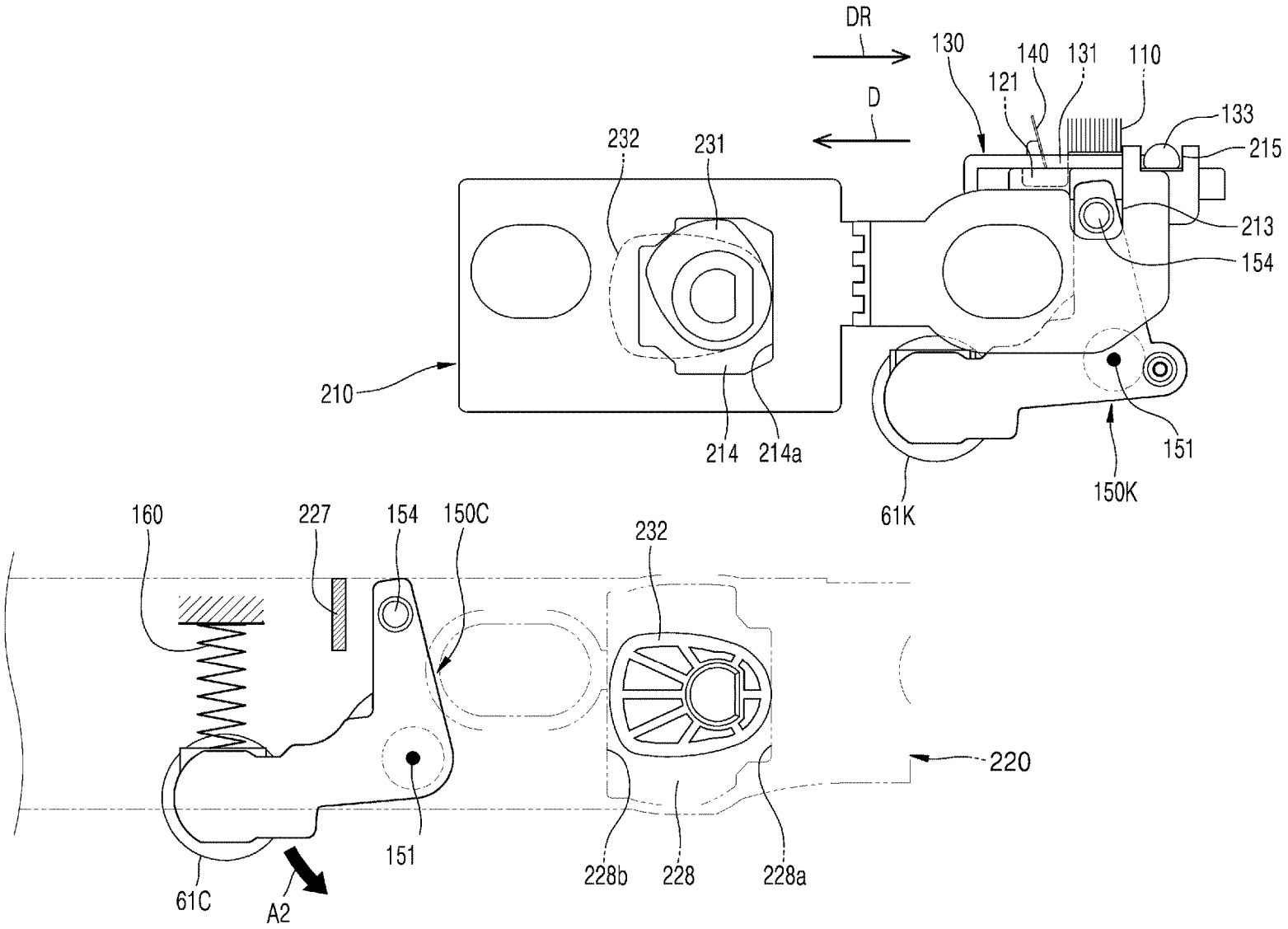

FIG. 7 is a partial exploded perspective view of an intermediate transfer belt assembly, according to an example. FIG. 8 is a perspective view of a cam member 230, according to an example. FIG. 9 is a perspective view of a connection structure between the shutter 130 and a first movement member 210, according to an example. FIGS. 10 through 12 are views showing an operation of a printing mode conversion unit, wherein FIG. 10 shows a standby mode, FIG. 11 shows a black and white mode, and FIG. 12 shows a color mode. In FIGS. 10 through 12, a second movement member 220 is illustrated as separate from the first movement member 210, for convenience of explanation.

Referring to FIGS. 7 and 8, according to the example, the shutter 130 may be moved to the opening location and the closing location in synchronization with the movement of the first intermediate transfer roller 61K to the intermediate transfer location and the releasing location. In other words, the printing mode conversion unit may include the cam member 230, the first movement member 210 to move the first intermediate transfer roller 61K by being connected to the cam member 230, and the second movement member 220 to move the plurality of second intermediate transfer rollers 61Y, 61M, and 61C. Also, the shutter 130 may be moved to the opening location and the closing location by being connected to the first movement member 210.

A plurality of holders 150 may include a hinge shaft 151, a first arm 152 and a second arm 153, wherein the first and second arms 152 and 153 extend from the hinge shaft 151 in different directions from each other. The plurality of holders 150 may be supported by the first frame 101 to be rotatable based on the hinge shaft 151. An end of the plurality of intermediate transfer rollers 61 may be rotatably supported by the first arm 152 of the plurality of holders 150. The plurality of holders 150 may be rotated based on the hinge shaft 151 to move the plurality of intermediate transfer rollers 61 to the intermediate transfer location and the releasing location. The plurality of holders 150 may be elastically biased by a plurality of elastic members 160 to be rotated in a direction to locate the plurality of intermediate transfer rollers 61 at the intermediate transfer location. Although not shown in the drawing, the other end of the plurality of intermediate transfer rollers 61 may be supported by the second frame 102 to be movable to the intermediate transfer location and the releasing location based on the same structure as described above. A protrusion unit 154 protruding in an axial direction may be formed at the second arm 153 of the plurality of holders 150.

According to an example, the printing mode conversion unit may include the cam member 230, the first movement member 210 to move the first intermediate transfer roller 61K by being connected to the cam member 230, and the second movement member 220 to move the plurality of second intermediate transfer rollers 61Y, 61M, and 61C.

Guide projections 191 and 192 may be formed at the first frame 101. Guide slots 211 and 212 extending (elongated) in the driving direction D may be formed in the first movement member 210. The first movement member 210 may be coupled to the first frame 101 such that the guide projections 191 and 192 are inserted into the guide slots 211 and 212, respectively. Based on this structure, the first movement member 210 may be supported by the first frame 101 to be movable in the driving direction D of the intermediate transfer belt 60. The first movement member 210 may include an insertion portion 213, into which the protrusion 154 formed at the second arm 153 of a holder 150K to support the first intermediate transfer roller 61K is inserted.

Based on this structure, when the first movement member 210 is moved in the driving direction D or the opposite direction of the driving direction D, the insertion portion 213 may push or pull the protrusion 154 of the holder 150K. Then, the holder 150K may be rotated based on the hinge shaft 151 so that the first intermediate transfer roller 61K may be moved to the intermediate transfer location and the releasing location.

Guide projections 193, 194, and 195 may be formed at the first frame 101. Guide slots 221, 222, 223, and 224 extending in the driving direction D may be formed in the second movement member 220. The second movement member 220 may be coupled to the first frame 101 such that the guide projections 192, 193, 194, and 195 are inserted into the guide slots 221, 222, 223, and 224, respectively. Based on this structure, the second movement member 220 may be supported by the first frame 101 to be movable in the driving direction D of the intermediate transfer belt 60. The second movement member 220 may include insertion portions 225, 226, and 227, into which the protrusion 154 formed at the second arm 153 of a plurality of holders 150Y, 150M, and 150C to support the plurality of second intermediate transfer rollers 61Y, 61M, and 61C is inserted. Based on this structure, when the second movement member 220 is moved in the driving direction D, the insertion portions 225, 226, and 227 may push or pull the protrusion 154 of the plurality of holders 150Y, 150M, and 150C. Then, each of the plurality of holders 150Y, 150M, and 150C may be rotated based on the hinge shaft 151 so that the plurality of second intermediate transfer rollers 61Y, 61M, and 61C may be moved to the intermediate transfer location and the releasing location.

A detachment prevention member 196 may be clamped at the guide projections 191, 192, and 195 so that the first movement member 210 and the second movement member 220 are not detached from the guide projections 191, 192, and 195 in an axial direction.

The first and second movement members 210 and 220 may be moved by the cam member 230 in the driving direction D. For example, a cam shaft 240 may be rotatably supported by the first and second frames 101 and 102. The cam shaft 240 may be rotated, for example, by a motor not shown. The cam member 230 may be coupled to an end of the cam shaft 240. The cam member 230 may include a first cam 231 and a second cam 232. The first cam 231 and the second cam 232 may be located to have a step difference in an axial direction. According to the example, the second cam 232 may be located more outwardly than the first cam 231. The first cam 231 may be inserted into a first cam slot 214 formed in the first movement member 210. The second cam 232 may be inserted into a second cam slot 228 formed in the second movement member 220.

The shutter 130 may be connected to the first movement member 210. According to an example, referring to FIG. 9, a first connection portion 133 may be formed at the shutter 130. A second connection portion 215 connected to the first connection portion 133 may be formed at the first movement member 210. According to an example, the first connection portion 133 may be in the form of a projection projecting from an end of the shutter 130 in an axial direction, and the second connection portion 215 may be in the form of a groove, into which the first connection portion 133 is inserted.

Although not shown in the drawing, the other end of the plurality of intermediate transfer rollers 61 may be supported by the second frame 102 to be movable to the intermediate transfer location and the releasing location based on the same structure as described above. The protrusion unit 154 protruding in the axial direction may be formed at the second arm 153 of the plurality of holders 150. Although not shown in the drawing, the first movement member 210 and the second movement member 220 may also be formed at the second frame 102, and the cam member 230 may be formed at the other end of the cam shaft 240. The other end of the shutter 130 and the first movement member 210 may be connected to each other by the first and second connection portions 133 and 215.

Referring to FIG. 10, the image forming apparatus 1 is in a standby mode. The first cam 231 may be inserted into the first cam slot 214 of the first movement member 210 and may push a side wall 214*a* of the first cam slot 214 in an opposite direction DR of the driving direction D. The first movement member 210 may be moved in the opposite direction DR. The insertion portion 213 may push the protrusion 154 of the holder 150K in the opposite direction DR, and the holder 150K may be rotated based on the hinge shaft 151 in a direction A1. The first intermediate transfer roller 61K may be moved to the releasing location. The second cam 232 may push a side wall 228*a* of the second cam slot 228 in the opposite direction DR of the driving direction D. The second movement member 220 may be moved in the opposite direction DR. The insertion portions 225, 226, and 227 may push the protrusion 154 of the holders 150Y, 150M, and 150C in the opposite direction DR, and the holders 150Y, 150M, and 150C may be rotated based on the hinge shaft 151 in the direction A1, that is, in the opposite direction of an elastic force of the elastic member 160. The plurality of second intermediate transfer rollers 61Y, 61M, and 61C may be moved to the releasing location.

Referring to FIGS. 4, 6, 8, and 10, as illustrated in FIG. 10, in a standby mode, the first cam 231 may push the side wall 214*a* of the first cam slot 214 in the opposite direction DR of the driving direction D, thereby moving the first movement member 210 in the opposite direction DR. Then, the shutter 130 may also be moved in the opposite direction DR to reach the closing location. As illustrated in FIGS. 4, 6, and 10, the opening 131 or the first and second openings 131 and 132 may deviate from the storage 121 or the first and second storages 121 and 122. Thus, the storage 121 or the first and second storages 121 and 122 may be closed by the shutter 130, and the impurities in the storage 121 or the first and second storages 121 and 122 may not be scattered to the outside.

Referring to FIG. 11, the image forming apparatus 1 is in a black and white mode. In order to convert the image forming apparatus 1 from a standby mode to the black and white mode, a printing mode conversion unit may rotate the cam member 230 by a first angle from a state illustrated in FIG. 10. For example, the first angle may correspond to an angle by which the first cam 231 is spaced apart from the side wall 214*a* of the first cam slot 214. The first movement member 210 may be put into a state to be movable in the driving direction D. By rotating the cam member 230 by the first angle, the holder 150K may be rotated in a direction A2 via an elastic force of the elastic member 160. The first intermediate transfer roller 61K may be moved to the intermediate transfer location. The protrusion 154 may push the insertion portion 213 in the driving direction D. The first movement member 210 may be moved in the driving direction D. Even when the cam member 230 is rotated by the first angle, the second cam 232 may maintain a state of contacting the side wall 228*a* of the second cam slot 228. Thus, the second movement member 220 may be maintained at a location illustrated in FIG. 10, and the plurality of second intermediate transfer rollers 61Y, 61M, and 61C may be maintained at the releasing location. In this state, black and white printing is possible.

Referring to FIGS. 3, 5, 8, and 11, when the image forming apparatus 1 is converted from the standby mode to the black and white mode, the first movement member 210 may be moved in the driving direction D. The second connection portion 215 may push the first connection portion 133 in the driving direction D. The shutter 130 may be moved in the driving direction D to be located at the opening location. The opening 131 or the first and second openings 131 and 132 may be aligned with the storage 121 or the first and second storages 121 and 122. Thus, the storage 121 or the first and second storages 121 and 122 may be opened, and the impurities removed from the inner surface of the intermediate transfer belt 60 by the cleaning member 110 in a black and white printing process may be accommodated in the storage 121 or the first and second storages 121 and 122.

Referring to FIG. 12, the image forming apparatus 1 may be in a color mode. To convert the image forming apparatus 1 from the black and white mode to the color mode, the printing mode conversion unit may rotate the cam member 230 by a second angle from a state illustrated in FIG. 11. For example, the second angle may correspond to an angle, by which the second cam 232 contacts a side wall 228*b* (FIG. 8) of the second cam slot 228, the side wall 228*b* being in the driving direction D. While the cam member 230 is rotated by the second angle, the second cam 232 may push, in the driving direction D, the side wall 228*b* of the second cam slot 228, the side wall 228*b* being in the driving direction D. The second movement member 220 may be moved in the driving direction D. The plurality of holders 150Y, 150M, and 150C may be rotated in the direction A2 due to an elastic force of the elastic member 160. The plurality of second intermediate transfer rollers 61Y, 61M, and 61C may be moved from the releasing location to the intermediate transfer location. Even when the cam member 230 is rotated by the second angle, the first cam 231 may be maintained to be spaced apart from the side wall 214*a* of the first cam slot 214. Thus, the first movement member 210 may be maintained at a location illustrated in FIG. 11, and the first intermediate transfer roller 61K may be maintained at the intermediate transfer location. In this state, color printing is possible.

Because the first movement member 210 is maintained at the location illustrated in FIG. 11, the shutter 130 may be maintained at the opening location, and the impurities removed from the inner surface of the intermediate transfer belt 60 by the cleaning member 110 in a color printing process may be accommodated in the storage 121 or the first and second storages 121 and 122.

As described above, in synchronization with the movement of the first intermediate transfer roller 61K between the intermediate transfer location and the releasing location, the shutter 130 may be moved between the opening location and the closing location. Also, by using the printing mode conversion unit to move the first intermediate transfer roller 61K between the intermediate transfer location and the releasing location, the shutter 130 may be moved between the opening location and the closing location. Thus, an additional driving unit to move the shutter 130 between the opening location and the closing location may not be needed, and thus, the material cost of the image forming apparatus 1 may be reduced.

Figure 13:
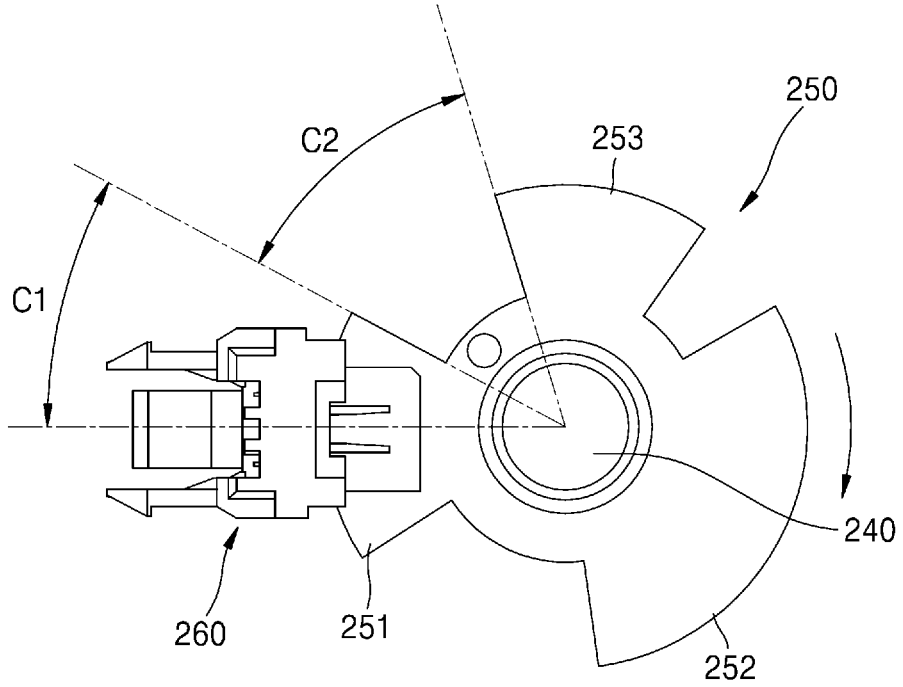
Figure 14:
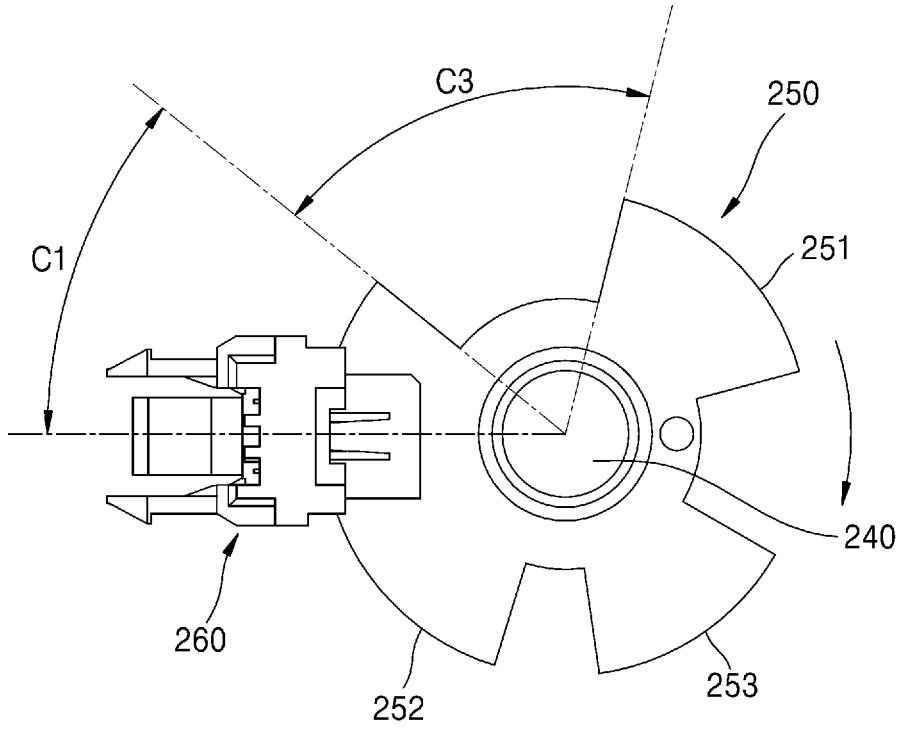
Figure 15:
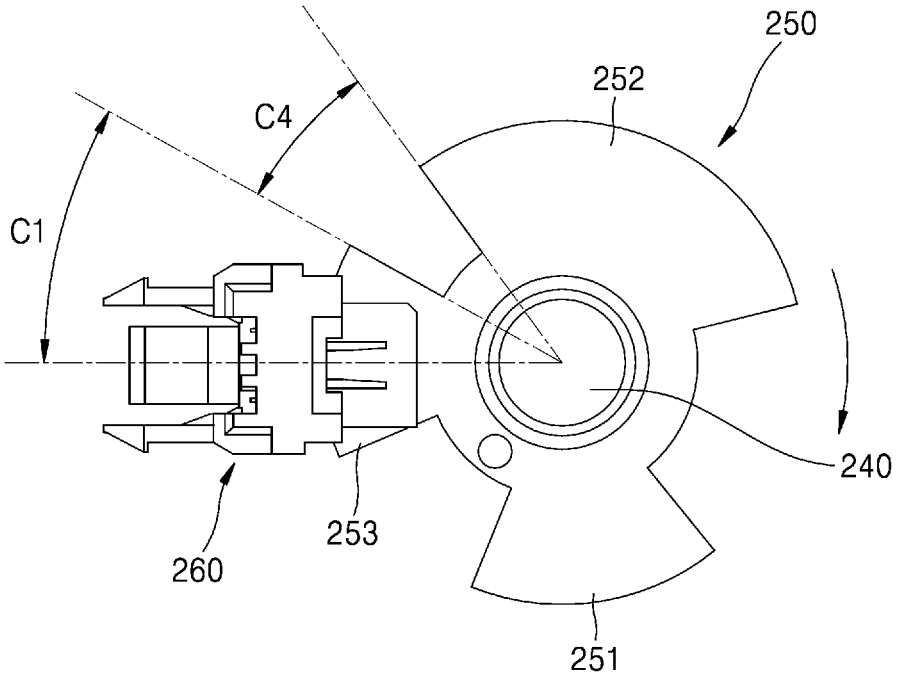

A printing mode may be detected based on various structures. For example, referring to FIG. 7, a mode cam 250 may be coupled to the cam shaft 240. The mode cam 250 may be detected by a sensor 260. FIGS. 13 through 15 are views showing a structure to detect a printing mode, according to an example, wherein FIG. 13 shows a standby mode, FIG. 14 shows a black and white mode, and FIG. 15 shows a color mode.

Referring to FIGS. 13 through 15, the mode cam 250 may include a first mode plate 251, a second mode plate 252, and a third mode plate 253. The first through third mode plates 251, 252, and 253 may be spaced apart from one another by a certain angle. The sensor 260 may be, for example, a light sensor including a light emitter and a light receiver. In a case where the first through third mode plates 251 through 253 are located between the light emitter and the light receiver, light is not detected by the light receiver, and in a case where spaces between the first through third mode plates 251 through 253 are located between the light emitter and the light receiver, light is detected by the light receiver. For example, when the light is detected, the sensor 260 may generate a detection signal that is proportional to the amount of the light.

For example, the detection signal of the sensor 260 when the light is detected may be called a signal high (H) and the detection signal of the sensor 260 when the light is not detected may be called a signal low (L). As illustrated in FIG. 13, after the first mode plate 251 is detected by the sensor 260 and rotated by an angle C1, that is, after the detection signal is changed from the signal low (L) to the signal high (H) and time for the first mode plate 251 to rotate by the angle C1 has passed, the mode cam 250 may stop being rotated. This state corresponds to the standby mode. In a state illustrated in FIG. 13, the mode cam 250 may be rotated in a clockwise direction. After the detection signal of the sensor 260 is changed from the signal high (H) to the signal low (L) and after the signal low (L) is maintained during the rotation of the mode cam 250 by an angle C3, the detection signal may be changed again to the signal high (H). This state corresponds to a state in which the second mode plate 252 is detected. In this state, after the mode cam 250 is rotated by the angle C1, the mode cam 250 may stop being rotated. This state corresponds to a state illustrated in FIG. 14, which is the black and white mode. In the state illustrated in FIG. 14, the mode cam 250 may be rotated in a clockwise direction. After the detection signal of the sensor 260 is changed from the signal high (H) to the signal low (L) and after the signal low (L) is maintained during the rotation of the mode cam 250 by an angle C4, the detection signal may be changed again to the signal high (H). This state corresponds to a state in which the third mode plate 253 is detected. In this state, after the mode cam 250 is rotated by the angle C1, the mode cam 250 may stop being rotated. This state corresponds to a state illustrated in FIG. 15, which is the color mode. The angles C2, C3, and C4 are different from one another. Thus, whether the first through third mode plates 251 through 253 are detected may be determined from a maintaining time period of the signal low (L).

In a case of a medium speed or a low speed image forming apparatus 1, the intermediate transfer belt 60 or the photosensitive drum 14 has a relatively short lifespan, and thus, the printing mode may include a black and white mode and a color mode, and the black and white mode may be a standby mode. In this case, the first intermediate transfer roller 61K may be located at the intermediate transfer location. The plurality of second intermediate transfer rollers 61Y, 61M, and 61C may be moved between the intermediate transfer location and the releasing location. The shutter 130 may be moved between the opening location and the closing location in synchronization with the movement of the plurality of second intermediate transfer rollers 61Y, 61M, and 61C between the intermediate transfer location and the releasing location.

Figure 16:
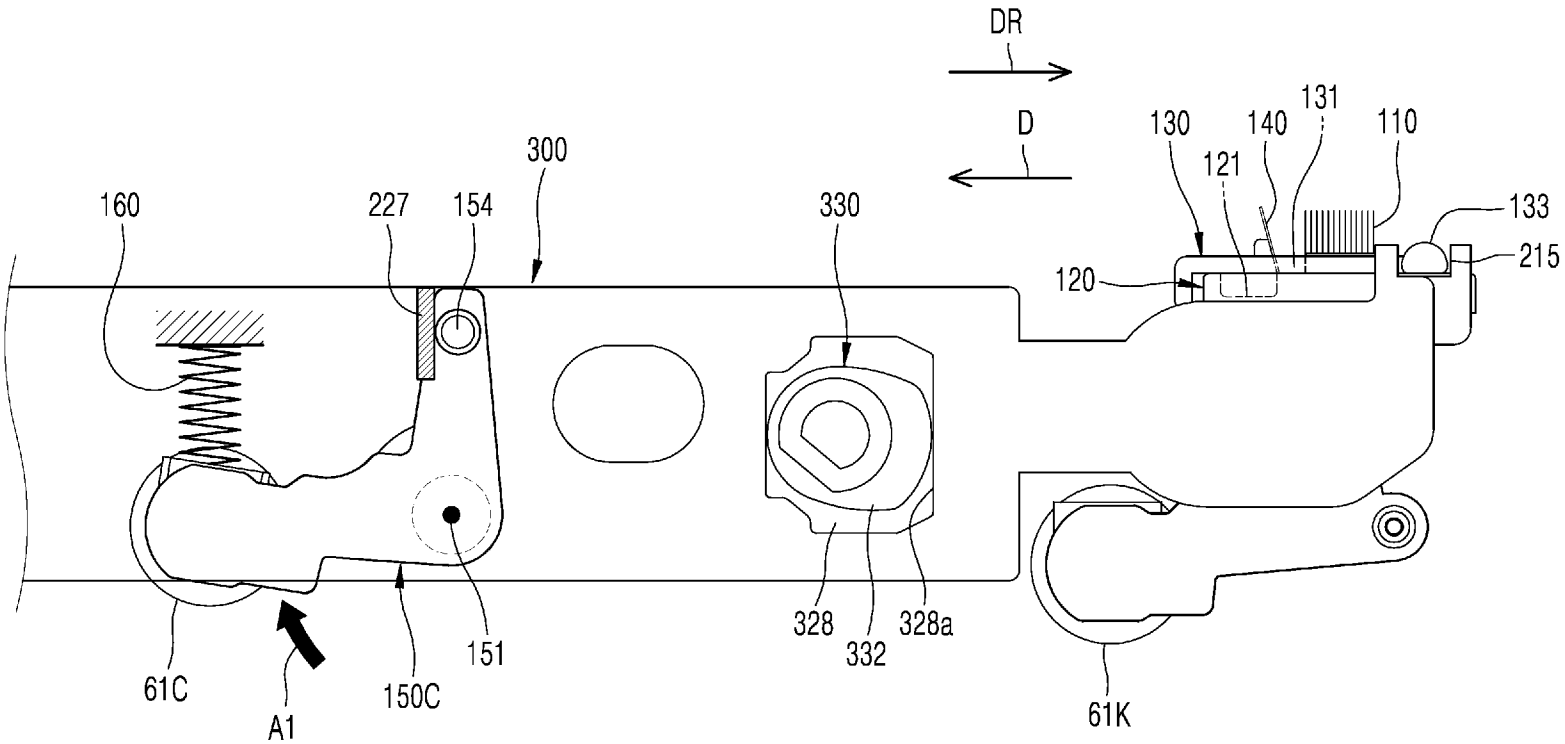
Figure 17:
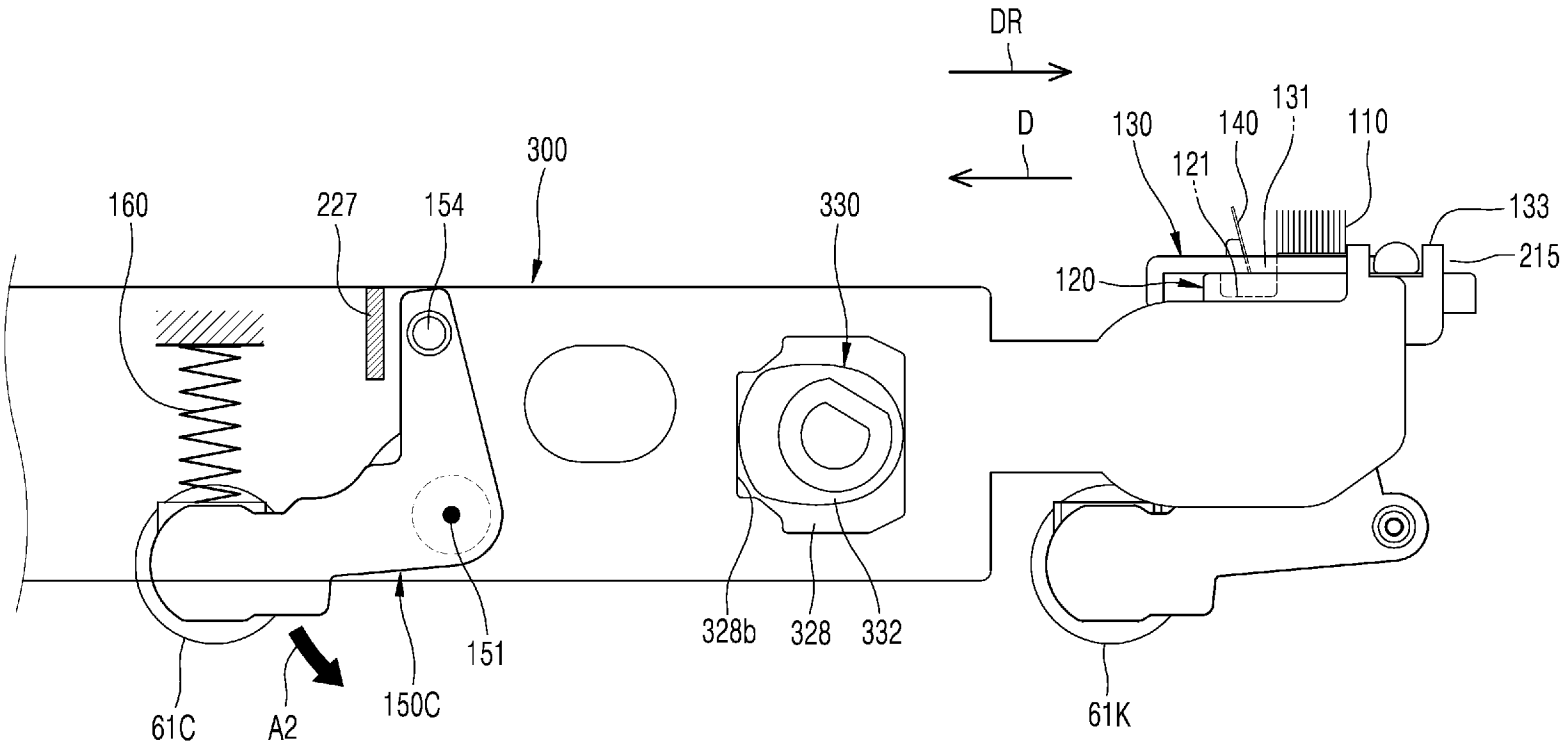

FIGS. 16 and 17 are views showing an operation of a printing mode conversion unit, wherein FIG. 16 shows a black and white mode and FIG. 17 shows a color mode. Referring to FIGS. 16 and 17, the printing mode conversion unit may include a cam member 330 and a movement member 300 to move the plurality of second intermediate transfer rollers 61Y, 61M, and 61C by being connected to the cam member 330. The shutter 130 may be connected to the movement member 300 and may be moved to an opening location and a closing location.

The image forming apparatus 1 according to the example may be different from the image forming apparatus 1 described above in that the image forming apparatus 1 according to the example may not include the first movement member 210, in that the second connection portion 215 connected to the first connection portion 133 of the shutter 130 may be formed at the second movement member 220 to move the plurality of second intermediate transfer rollers 61Y, 61M, and 61C, and in that the cam member 230 may not include the first cam 231. Hereinafter, the cam member 230, in which the first cam 231 is not formed, may correspond to the cam member 330, and the second movement member 220, at which the second connection portion 215 is formed, may correspond to the movement member 300. The second cam 232 may correspond to a cam 332, and the second cam slot 228 may correspond to a cam slot 328.

Referring to FIG. 16, the image forming apparatus 1 is in a black and white mode. The cam 332 may be inserted into the cam slot 328 of the movement member 300 and may push a side wall 328*a* of the cam slot 328 in the opposite direction DR of the driving direction D. The movement member 300 may be moved in the opposite direction DR. The insertion portions 225, 226, and 227 may push the protrusion 154 of the holders 150Y, 150M, and 150C in the opposite direction DR, and the holders 150Y, 150M, and 150C may be rotated based on the hinge shaft 151 in the direction A1, that is, in the opposite direction of an elastic force of the elastic member 160. The plurality of second intermediate transfer rollers 61Y, 61M, and 61C may be moved to a releasing location. The first intermediate transfer roller 61K may be located (fixed) at an intermediate transfer location, and thus, in this state, black and white printing is possible.

The shutter 130 may be connected to the movement member 300 by the first and second connection portions 133 and 215. Thus, in the black and white mode, when the movement member 300 is moved in the opposite direction DR, the shutter 130 may also be moved in the opposite direction DR to reach the closing location. As illustrated in FIGS. 4, 6, and 16, the opening 131 or the first and second openings 131 and 132 may deviate from the storage 121 or the first and second storages 121 and 122. Thus, the storage 121 or the first and second storages 121 and 122 may be closed by the shutter 130, and the impurities in the storage 121 or the first and second storages 121 and 122 may not be distributed to the outside.

Referring to FIG. 17, the image forming apparatus 1 is in a color mode. To convert the image forming apparatus 1 from the black and white mode to the color mode, a printing mode conversion unit may rotate the cam member 230 by a certain angle, for example, by about 180 degrees, in a state illustrated in FIG. 16. While the cam member 330 is rotated by 180 degrees, the cam 332 may push, in the driving direction D, a side wall 328*b* of the second cam slot 328, the side wall 328*b* being in the driving direction D. The movement member 300 may be moved in the driving direction D. The plurality of holders 150Y, 150M, and 150C may be rotated in the direction A2 due to an elastic force of the elastic member 160. The plurality of second intermediate transfer rollers 61Y, 61M, and 61C may be moved from the releasing location to the intermediate transfer location. The first intermediate transfer roller 61K may be located (fixed) at the intermediate transfer location. In this state, color printing is possible.

Because the movement member 300 is moved in the driving direction D, the shutter 130 may also be moved in the driving direction D to reach the opening location. As illustrated in FIGS. 3, 5, and 17, the opening 131 or the first and second openings 131 and 132 may be aligned with the storage 121 or the first and second storages 121 and 122. Thus, the storage 121 or the first and second storages 121 and 122 may be opened, and the impurities removed from the inner surface of the intermediate transfer belt 60 by the cleaning member 110 in a color printing process may be accommodated in the storage 121 or the first and second storages 121 and 122.

As described above, in synchronization with the movement of the second intermediate transfer rollers 61Y, 61M, and 61C between the intermediate transfer location and the releasing location, the shutter 130 may be moved between the opening location and the closing location. Also, by using the printing mode conversion unit to move the second intermediate transfer rollers 61Y, 61M, and 61C between the intermediate transfer location and the releasing location, the shutter 130 may be moved between the opening location and the closing location. Thus, an additional driving unit to move the shutter 130 between the opening location and the closing location may not be needed, and thus, the material cost of the image forming apparatus 1 may be reduced.

While the disclosure has been shown and described with reference to examples thereof, they are provided for illustration and various modifications and equivalent other examples can be made from the disclosure. Accordingly, the technical scope of the disclosure is defined by the technical spirit of the appended claims.

What is claimed is:

1. An image forming apparatus, comprising:

a plurality of photosensitive drums;

an intermediate transfer belt;

a cleaning member to contact an inner surface of the intermediate transfer belt to remove impurities from the intermediate transfer belt;

a storage member including a storage to accommodate the impurities removed by the cleaning member;

a shutter movable to a first location at which the storage is opened and a second location at which the storage is closed; and a plurality of intermediate transfer rollers located to face the plurality of photosensitive drums with the intermediate transfer belt disposed between the plurality of intermediate transfer rollers and the plurality of photosensitive drums, wherein at least one of the plurality of intermediate transfer rollers is movable between an intermediate transfer location to form an intermediate transfer nip by applying pressure to the intermediate transfer belt to allow the intermediate transfer belt to contact the plurality of photosensitive drums corresponding thereto, and to a releasing location to release the intermediate transfer nip, and the shutter is movable between the first location and the second location in synchronization with movement of the at least one of the plurality of intermediate transfer rollers between the intermediate transfer location and the releasing location.

2. The image forming apparatus of claim 1, wherein the plurality of intermediate transfer rollers include a first intermediate transfer roller to perform black and white printing and a plurality of second intermediate transfer rollers to perform color printing, and the shutter is movable between the first location and the second location in synchronization with movement of the first intermediate transfer roller between the intermediate transfer location and the releasing location.

3. The image forming apparatus of claim 1, wherein the plurality of intermediate transfer rollers include a first intermediate transfer roller to perform black and white printing and a plurality of second intermediate transfer rollers to perform color printing, the first intermediate transfer roller is located at the intermediate transfer location, the plurality of second intermediate transfer rollers are movable between the intermediate transfer location and the releasing location, and the shutter is movable between the first location and the second location in synchronization with movement of at least one of the plurality of second intermediate transfer rollers between the intermediate transfer location and the releasing location.

4. The image forming apparatus of claim 1, wherein the storage is located downstream of the cleaning member based on a driving direction of the intermediate transfer belt.

5. The image forming apparatus of claim 4, further comprising a flexible sealing member to contact the inner surface of the intermediate transfer belt downstream of the storage based on the driving direction of the intermediate transfer belt.

6. The image forming apparatus of claim 5, wherein the cleaning member and the sealing member are mounted at the shutter.

7. An image forming apparatus, comprising:

a plurality of photosensitive drums;

an intermediate transfer belt;

a cleaning member to contact an inner surface of the intermediate transfer belt to remove impurities from the intermediate transfer belt;

a storage member including a storage to accommodate the impurities removed by the cleaning member; and a shutter movable to a first location at which the storage is opened and a second location at which the storage is closed;

wherein the storage is located downstream of the cleaning member based on a driving direction of the intermediate transfer belt and the storage member includes another storage, located upstream of the cleaning member based on the driving direction of the intermediate transfer belt, to accommodate the impurities removed by the cleaning member.

8. An image forming apparatus, comprising:

a plurality of photosensitive drums;

an intermediate transfer belt;

a plurality of intermediate transfer rollers located to face the plurality of photosensitive drums with the intermediate transfer belt disposed between the plurality of intermediate transfer rollers and the plurality of photosensitive drums;

a printing mode conversion unit to move, according to a printing mode, at least one of the plurality of intermediate transfer rollers between an intermediate transfer location at which an intermediate transfer nip is formed by applying pressure to the intermediate transfer belt to allow the intermediate transfer belt to contact the plurality of photosensitive drums, and a releasing location at which the intermediate transfer nip is released;

a cleaning member to contact an inner surface of the intermediate transfer belt to remove impurities from the intermediate transfer belt;

a storage member including a storage to accommodate the impurities removed by the cleaning member; and a shutter movable to a first location at which the storage is opened and a second location at which the storage is closed, in accordance with the printing mode conversion unit.

9. The image forming apparatus of claim 8, wherein the plurality of intermediate transfer rollers include a first intermediate transfer roller to perform black and white printing and a plurality of second intermediate transfer rollers to perform color printing, the printing mode conversion unit includes a cam member, a first movement member connectable with the cam member to move the first intermediate transfer roller, and a second movement member to move the plurality of second intermediate transfer rollers, and the shutter is movable to the first location and the second location based on a connection of the shutter to the first movement member.

10. The image forming apparatus of claim 8, wherein the plurality of intermediate transfer rollers include a first intermediate transfer roller to perform black and white printing and a plurality of second intermediate transfer rollers to perform color printing, the printing mode conversion unit includes a cam member and a movement member connectable with the cam member to move the plurality of second intermediate transfer rollers, and the shutter is movable to the first location and the second location based on a connection of the shutter to the movement member.

11. The image forming apparatus of claim 8, wherein the storage is located downstream of the cleaning member based on a driving direction of the intermediate transfer belt.

12. The image forming apparatus of claim 11, wherein the storage member includes another storage, located upstream of the cleaning member based on the driving direction of the intermediate transfer belt, to accommodate the impurities removed by the cleaning member.

13. The image forming apparatus of claim 11, further comprising a flexible sealing member to contact the inner surface of the intermediate transfer belt downstream of the storage based on the driving direction of the intermediate transfer belt.

14. The image forming apparatus of claim 13, wherein the cleaning member and the sealing member are mounted at the shutter.

* * * * *